United States Patent [19]

Moriya et al.

[11] Patent Number: 4,782,198

[45] Date of Patent: Nov. 1, 1988

[54] SUSPENSION INSULATORS

[75] Inventors: Tsutomu Moriya, Chita; Hiroyuki Shinokubo, Konan, both of Japan

[73] Assignee: NGK Insulators, Ltd., Nagoya, Japan

[21] Appl. No.: 19,137

[22] Filed: Feb. 25, 1987

[30] Foreign Application Priority Data

May 22, 1986 [JP] Japan ..... 61-118316

[51] Int. Cl.[4] ..... H01B 17/08

[52] U.S. Cl. ..... 174/182; 174/189

[58] Field of Search ..... 174/182, 186, 188, 189, 174/191, 192, 196, 197, 198, 212

[56] References Cited

U.S. PATENT DOCUMENTS

| | | | |
|---|---|---|---|
| 1,737,749 | 12/1929 | Austin | 174/192 X |
| 1,981,717 | 11/1934 | Austin | 174/182 |
| 2,008,414 | 7/1935 | Fischer | 174/182 |
| 4,427,844 | 1/1984 | Saby et al. | 174/188 |

*Primary Examiner*—Laramie E. Askin

*Attorney, Agent, or Firm*—Parkhurst & Oliff

[57] ABSTRACT

A suspension insulator includes a compressive strain of more than $60\times10^{-6}$ in the ceramic insulator body at least in the circumferential direction in the vicinity of the shed root of the ceramic head portion of the suspension insulator, whereby a suspension insulator causes no accidents such as separation of cap and pin of suspension insulator, line drop of power transmission lines and the like, even when shot by a rifle.

6 Claims, 4 Drawing Sheets

SUSPENSION INSULATORS

BACKGROUND OF THE INVENTION

1. Field of the Invention

The present invention relates to a suspension insulator structured so as to prevent the separation of the cap and pin of the insulator even when shot by a rifle, for example, thus preventing a serious accident such as a line drop of power transmission lines and the like.

2. Related Art Statement

A suspension insulator for supporting a power transmission line and the like is sometimes attacked as a shooting target by a rifle and the like. There has been such a case that when a bullet hits a shed portion of an insulator, a crack extends to a ceramic head porton, and an insulator string is disconnected by lightning and the like thereafter, or sometimes broken down to pieces, and thereby resulting in insufficient functioning of the suspension insulator. As a result, the broken conductor and/or electric failure of a power transmission line occurs to cause an unexpected disastrous accident. Such accidents have occurred frequently in North America, South America, Australia and other places where high-speed bullets are used for hunting. Therefore, the crack-resistant strength of the insulator shell was improved by changing the material from feldspathic ceramics to alumina-containing ceramics, but when an insulator is shot by a rifle, it is impossible to completely prevent a crack from extending to the head portion of the insulator.

SUMMARY OF THE INVENTION

The object of the present invention is to overcome the problems described above and to provide a suspension insulator, particularly a suspension insulator having excellent resistance to gun fire, which can satisfy the required electrical and mechanical properties and while simultaneously giving superior crack-resistant performance without extending any cracks to the head portion, even if it is shot by a rifle.

The invention is characterized by forming a compressive strain of more than $60\times10^{-6}$ in the circumferential direction at least in the vicinity of the shed root of the ceramic head portion of the suspension insulator.

An object of the invention is to provide a compressive strain of more than $60\times10^{-6}$ in the circumferential direction formed in the vicinity of the shed root of the ceramic head portion, so that even if the shed portion of the insulator is cracked due to a rifle shot, extension of the crack is stopped by this compressive strain zone and never reaches the ceramic head portion which directly bears the load of the insulator. Therefore, although the shed portion may be broken down, the whole insulator string is kept as it is so as not to invite any catastrophic accident such as the line drop of a power transmission line. The reason why the value of the compressive strain is made of more than $60\times10^{-6}$ is because any value less than that cannot obtain a sufficient effect as shown in examples explained hereafter. The reason why the compressive strain in the circumferential direction is of particular concern is because separation of the cap and pin of the insulator inevitably occurs as a result of extension of cracks by tensile stresses in the circumferential direction, so that if a compressive strain zone is previously formed, the tensile stress is cancelled, thereby stopping crack extension.

BRIEF DESCRIPTION OF THE DRAWINGS

For a better understanding of the invention, reference is made to the accompanying drawings, in which.

DESCRIPTION OF THE PREFERRED EMBODIMENTS

An example of the invention will be explained in detail as follows.

Figure 1:
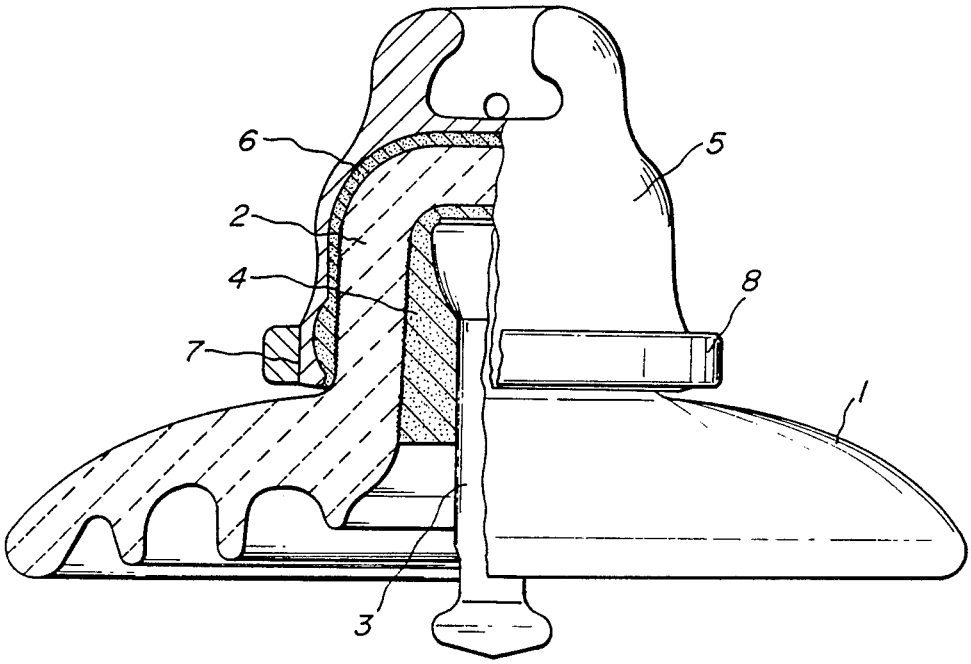
FIG. 1 is a partially cutaway front view showing a first embodiment of the invention.

FIG. 1 shows a first embodiment of the invention, in which (1) is a shed portion, (2) is a ceramic head portion, (3) is a pin secured to the inside of the ceramic head portion (2) by cement (4), and (5) is a cap secured to the outside of the ceramic head portion (2) by cement (6). In this embodiment, a skirt portion of the cap (5) is formed with a linear portion (7), and a metal ring (8) is mated with the linear portion (7) by shrink fitting, or the like, thereby forming a compressive strain which makes a ceramic strain more than $60\times10^{-6}$ in the vicinity of the shed root of the ceramic head portion (2) in the circumferential direction.

Figure 2:
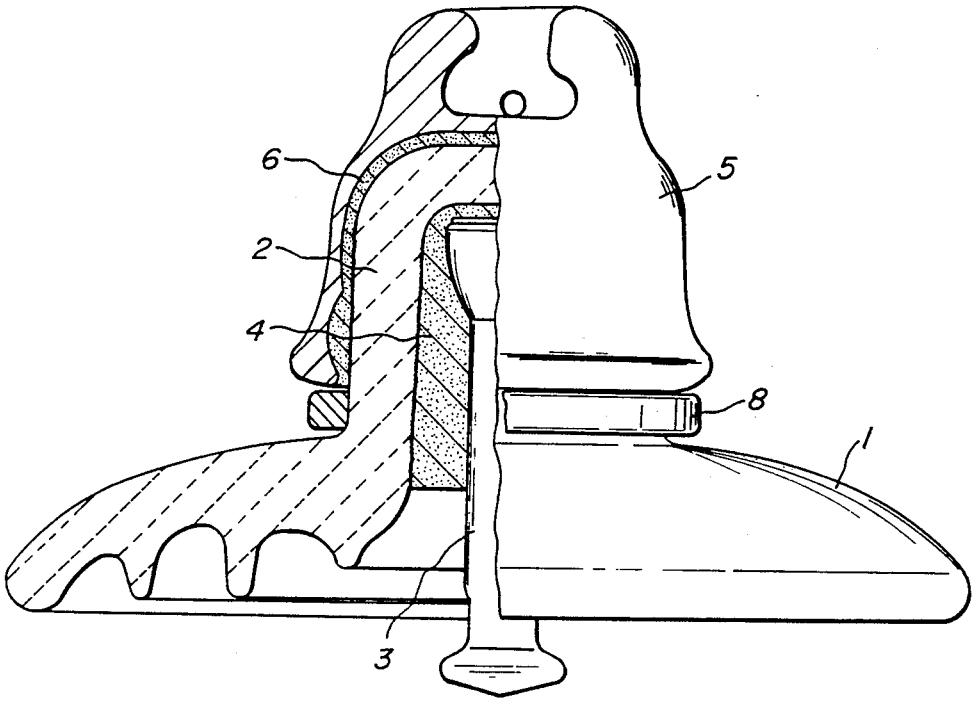
FIG. 2 is a partially cutaway front view showing a second embodiment of the invention.

FIG. 2 shows a second embodiment of the invention, and in this embodiment, a ring (8) is directly mated with the ceramic head portion (2) by shrink fitting, or the like to form a compressive strain at that portion. The reference numerals used in FIG. 2 apply to the same components as in FIG. 1.

Figure 3:
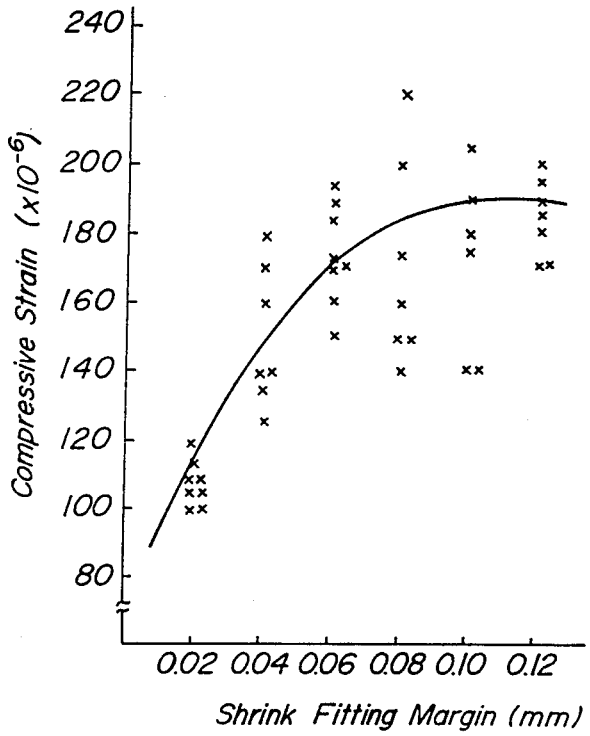
FIG. 3 is a graph showing the relation between a shrink fitting margin and a compressive strain in the embodiment.

Tensile strength test:

There was measured the relation between the compressive strain in the circumferential direction and tensile strength after breaking down of the shed portion by a bullet with the use of the suspension insulator according to the invention shown in FIG. 1. A specimen was a 250 mm ball socket type suspension insulator categorized in ANS I C29.2, class 52-5, and the outer diameter of a cap was cut into 120 mm and the cap was mated with a metal ring of 10 mm in thickness and 13 mm in height by a shrink fitting method. The shrink fitting in this case was varied into several steps such as 0.02–0.12 mm as shown in FIG. 3, each kind of compressive strains was formed, tensile load in the axial direction of 4–10 ton was applied by an Amsler type mechanical testing machine, and the shed portion was broken by a rifle.

Figure 4:
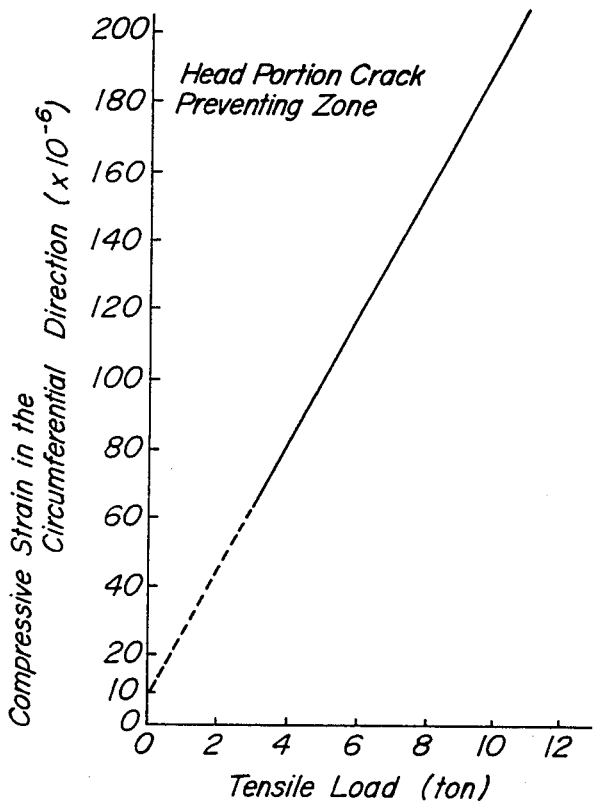
FIG. 4 is a graph showing the relation between a compressive strain and a tensile load.

FIG. 4 is a graph showing this test result, showing that at the portion below this straight line separation of the cap and pin of an insulator occurs by a crack extension to the ceramic head portion, and at the portion above this straight line the crack which occurred at the shed portion does not reach to the ceramic head portion and no separation of insulator occurs. Thus, when the compressive strain in the circumferential direction is made of more than $60\times10^{-6}$, under the tensile load for the insulator, it was confirmed that extension of the crack started at the shed portion by a rifle can be stopped in the vicinity of the shed root of the ceramic head portion. In addition, it is possible to use a wire of a large diameter as a metal ring, but in order to avoid concentration of compressive stress, it is preferable to use a wide band-like ring as shown in the embodiment.

Shooting test:

The cap skirt portion of the 248 mm suspension insulator having the shape shown in FIG. 1 was machined to an outer diameter of 86 mm, thereafter a metal ring having an outer diameter of 106 mm, a thickness and a width of 10 mm was shrink fitted. To simulate the actual condition, a tensile load was applied to the insulator, and the insulator was set at an angle of 45° to a trajectory. A rifle was fired from a distance of 15 m from the suspension insulator at the same height as a shooting target. The shooting target is a recess between an outermost rib and a second rib from the outermost rib. A Savage 222 Remington long rifle model 340 was used to fire a 222 Remington bullet (bullet speed 957 m/s, energy 151 kg·m) which is considered to be a high-speed bullet. Five suspension insulators with shrink fitting margins of the metal rings of 0.06 mm and 0.10 mm were shot. The insulator caps were cut and removed, and extensions of cracks into the ceramic head portions were examined. As a result, no extensions of cracks to the head portions of all ten tested suspension insulators were found, and a remarkable effect was confirmed.

As apparent from the above explanation, the present invention can prevent disastrous accidents such as the separation of the cap and pin of an insulator unit resulting in a line drop of a power-transmission line and the like by intercepting extension of cracks with the compressive strain zone even when the shed portion was shot by a bullet such as a rifle and the like. Further, apart from the suspension insulator provided with a bulletproof board and the like, this new suspension insulator based on the invention is not bulky and is cheap in manufacturing cost with the use of ordinary ceramics. Therefore, the invention greatly contributes to the field concerned, as this type of suspension insulator can solve the conventional problems.

Although the invention has been described with a certain degree of particularly by referring to preferred embodiments, numerous modifications are possible in parts and arrangement without departing from the scope of the invention as hereinafter claimed.

What is claimed is:

1. A suspension insulator comprising:

a bell-shaped ceramic insulator body having a radial shed portion and a radial head portion, said head portion having an outer surface which contacts said shed portion at a shed root portion of said head portion and an inner cavity;

a metal cap having an inner surface and an outer surface, said metal cap being secured to said outer surface of said head portion and in contact with said shed root portion;

a connecting pin secured in said inner cavity of said head portion; and a metal ring shrink fitted on said outer surface of said metal cap surrounding said shed root portion so as to apply a prestress to said shed root portion;

wherein a compressive strain of at least $60\times10^{-6}$ exists in a circumferential direction within said body at about said shed root portion.

2. The suspension insulator of claim 1, wherein said metal cap is cemented on said outer surface.

3. The suspension insulator of claim 1, wherein said connecting pin is cemented in said inner cavity.

4. A suspension insulator comprising:

a bell-shaped ceramic insulator body having a radial shed portion and a radial head portion, said head portion having an outer surface which contacts said shed portion at a shed root portion of said head portion and an inner cavity;

a metal cap secured on said outer surface;

a connecting pin secured in said inner cavity; and a metal ring shrink fitted on said outer surface of said head portion surrounding said shed root portion so as to apply a prestress to said shed root portion;

wherein a compressive strain of at least $60\times10^{-6}$ exists in a circumferential direction within said body at about said shed root portion.

5. The suspension insulator of claim 4, wherein said metal cap is cemented on said outer surface.

6. The suspension insulator of claim 4, wherein said connecting pin is cemented in said inner cavity.

* * * * *